US006041467A

United States Patent [19]

Roberts et al.

[11] Patent Number: 6,041,467

[45] Date of Patent: Mar. 28, 2000

[54] TOOTHBRUSH

[75] Inventors: Michael F. Roberts, Quincy, Mass.; Thomas Craig Masterman, Foster City; William A. Bredall, Pacifica, both of Calif.; Robert L. Hicks, Iowa City, Iowa; Donna J. Beals, Sunnyvale; Bradley Edward Castillo, San Ramon, both of Calif.

[73] Assignee: Gillette Canada Inc., Kirkland, Canada

[21] Appl. No.: 08/887,866

[22] Filed: Jul. 3, 1997

[51] Int. Cl.[7] ..... A46B 9/04

[52] U.S. Cl. ..... 15/167.1; 15/110; 15/188; 601/141; 132/309

[58] Field of Search ..... 15/110, 111, 117, 15/167.1, 187, 188; 132/308, 309; 601/139, 141

[56] References Cited

U.S. PATENT DOCUMENTS

| | | | |
|---|---|---|---|
| 1,142,698 | 6/1915 | Grove et al. | 15/117 |
| 1,191,556 | 7/1916 | Blake | 15/117 |
| 1,852,480 | 4/1932 | Ruetz | 132/309 |
| 1,924,152 | 8/1933 | Coney et al. | 15/110 X |
| 2,088,839 | 8/1937 | Coney et al. | 15/110 X |
| 2,139,245 | 12/1938 | Ogden | 601/139 |
| 2,154,846 | 4/1939 | Heymann et al. | 15/188 X |
| 2,219,753 | 10/1940 | Sequin | 15/188 |
| 2,279,355 | 4/1942 | Wilensky | 15/110 |
| 2,637,870 | 5/1953 | Cohen | 15/188 |
| 3,103,027 | 9/1963 | Birch | 15/110 |
| 3,133,546 | 5/1964 | Dent | 132/120 |
| 3,230,562 | 1/1966 | Birch | 15/110 |
| 3,491,396 | 1/1970 | Eannarino et al. | 15/104.94 |
| 3,553,759 | 1/1971 | Kramer et al. | 15/110 |
| 4,115,893 | 9/1978 | Nakata et al. | 15/110 |
| 4,128,910 | 12/1978 | Nakata et al. | 15/110 |
| 4,167,794 | 9/1979 | Pomeroy | 15/188 |
| 4,268,933 | 5/1981 | Papas | 15/167.1 |
| 4,277,862 | 7/1981 | Weideman | 15/110 |
| 4,573,920 | 3/1986 | d'Argembeau | 433/141 |
| 4,691,405 | 9/1987 | Reed | 15/201 |
| 5,040,260 | 8/1991 | Michaels | 15/167.1 |
| 5,226,197 | 7/1993 | Nack et al. | 15/111 |
| 5,249,327 | 10/1993 | Hing | 15/104.94 |
| 5,535,474 | 7/1996 | Salazar | 15/110 |
| 5,802,656 | 9/1998 | Dawson et al. | 15/110 |

FOREIGN PATENT DOCUMENTS

| | | |
|---|---|---|
| 360766 | 3/1990 | European Pat. Off. . |
| 4-123121 | 11/1992 | Japan . |
| 96/15696 | 5/1996 | WIPO . |

*Primary Examiner*—Mark Spisich
*Attorney, Agent, or Firm*—Fish & Richardson P.C.

[57] ABSTRACT

A toothbrush for cleaning teeth, especially the interproximal region between adjacent, closely spaced or normally contacting teeth, has at least one fin extending from the body of the toothbrush through the bristled head. The fin is a thin, tapering, blade-like member with a distal edge for cleaning teeth by scraping motion. The fin is molded from plastic resin, and is constructed so as to resist buckling loads to tend to penetrate and clean the interproximal tooth surfaces, even to the point of temporarily separating lightly contacting surfaces of adjacent teeth. Various fin embodiments are presented, including one that has an outwardly-biasing loop portion. Methods of use and manufacture and preferred materials are also disclosed.

42 Claims, 8 Drawing Sheets

TOOTHBRUSH

BACKGROUND OF THE INVENTION

This invention relates to toothbrushes.

The variety of arrangements of surfaces of teeth can complicate proper oral hygiene, and perhaps the most common tool for cleaning them is the toothbrush. The bristles of a toothbrush remove loose debris from the exposed top and side surfaces, including the proximal surfaces, of teeth.

The surfaces between adjacent teeth (i.e., the interproximal surfaces) can be much more difficult to clean. Generally, these facing surfaces are separated by only a very narrow gap which leaves little room for the penetration of bristles. In many cases, the interproximal surfaces of adjacent teeth are in contact with each other, further complicating the cleaning task.

Tooth surfaces below the gum line can also be difficult to properly clean. Dental floss can help to clean the areas not reachable by most toothbrushes.

Some tooth-cleaning elements of toothbrushes remove debris by a rubbing action, similar in some respects to how a dentist's prophy cup cleans teeth. Such elements have soft, rubbery surfaces that are rubbed against the tooth to remove material by friction and abrasion. These types of elements are also useful for massaging gums. Some other tooth-cleaning elements have exposed, relatively stiff edges for removing debris from the tooth by scraping. Although scraping elements can be effective at removing difficult debris, they can also cause pain if scraped against tender gum surfaces, especially if they have sharp corners that can gouge gum tissue.

SUMMARY OF THE INVENTION

We have realized that, if properly constructed and arranged in a toothbrush with other tooth-cleaning elements, a scraping element can be effective at cleaning difficult tooth surfaces, especially interproximal areas between normally contacting or very closely-spaced teeth and surfaces below the gum line, while remaining friendly to sensitive gum tissue.

According to one aspect of the invention, a toothbrush for cleaning the interproximal region between adjacent, normally contacting teeth, has a body, bristles attached to and extending from the body to form a brush for cleaning the teeth, and a contact-breaking fin extending from the body. The fin is constructed to temporarily separate said teeth to penetrate and clean the interproximal region by scraping motion. The fin is preferably disposed among the bristles.

In some embodiments, the thickness of the distal end of the fin is preferably less than about 0.005 inch, most preferably less than about 0.002 inch.

The thickness of the fin, in some constructions, defines an included taper angle, between two opposite sides of the fin, of between about 0.2 and 12 degrees. This included taper angle is preferably between about 0.4 and 2.6 degrees, most preferably about 2.0 degrees.

Some of the toothbrushes of the invention have fins that extend at an extension angle of between about 65 and 80 degrees, preferably between about 70 and 75 degrees, and most preferably about 73 degrees, as measured with respect to the body of the toothbrush. Some toothbrushes of the invention have two such fins arranged to extend from the body of the toothbrush toward one another, defining therebetween an included angle of between about 20 and 50 degrees, preferably between about 30 and 40 degrees, and most preferably about 34 degrees.

In one embodiment, the fin has two normally co-planar extensions having separate distal ends and joined together at a base region, such that the distal ends of the extensions are independently deflectable.

In another embodiment, the fin has a ribbon-form loop portion and a tooth-cleaning portion. The ribbon-form loop portion extends from the body of the toothbrush and has two ends attached to the body, such that the loop portion is bowed away from the body. The tooth-cleaning portion extends from the loop portion from a point about midway between the two ends of the loop portion in a direction away from the body of the toothbrush. The loop portion is constructed to bias the tooth-cleaning portion away from the body. The tooth-cleaning portion preferably has two normally co-planar extensions having separate distal ends. The co-planar extensions are joined together at a base region, such that the distal ends of the extensions are independently deflectable.

In some embodiments, the fin is constructed to change appearance with extended use.

According to another aspect of the invention, a toothbrush for cleaning the interproximal region between adjacent teeth has a body, bristles attached to and extending from the body to form a brush for cleaning the teeth, and a fin. The fin has two broad, opposite sides and is attached to the body at a base, extending through the brush to a distal end. The fin has a thickness which tapers away from the body toward a distal end, the thickness of the distal end of the fin being less than about 0.005 inch. The fin includes a plastic resin with a bending modulus of between about 2,000 and 500,000 pounds per square inch (preferably between about 2,000 and 200,000 pounds per square inch, and most preferably between about 10,000 and 100,000 pounds per square inch).

According to another aspect of the invention, a toothbrush for cleaning the interproximal region between adjacent teeth has a body, multiple tooth-cleaning elements attached to and extending from the body, and a fin. The fin has two broad, opposite sides and is attached to the body at a base, extending among the tooth-cleaning elements. The fin has a thickness which tapers away from the body toward its distal end (the thickness of the distal end of the fin being less than about 0.005 inch), and the fin comprises a plastic resin with a bending modulus of between about 10,000 and about 100,000 pounds per square inch.

In some instances, the fin may contain an additive to improve slipperiness, such as tetrafluoroethylene or silicone. Other additives, such as aluminosilicate, may be employed to provide a desired fin texture.

According to another aspect of the invention, a toothbrush for cleaning the interproximal region between adjacent, normally contacting teeth, has a body, bristles attached to and extending from the body to form a brush for cleaning the teeth, and contact-breaking means extending from the body, the contact-breaking means constructed to temporarily separate the teeth to penetrate and clean the interproximal region by scraping motion.

According to another aspect of the invention, a method of cleaning interproximal, normally contacting surfaces between adjacent teeth is provided. The method includes moving the above-described toothbrushes across the embrasure of the adjacent teeth such that the fin temporarily separates the teeth and penetrates between the teeth to scrape the interproximal surfaces of the teeth.

According to another aspect of the invention, a method of cleaning interproximal surfaces between adjacent teeth separated by a narrow gap is provided, using the above-described toothbrushes. This method includes moving the brush across the embrasure of the adjacent teeth such that the fin penetrates between the teeth into the narrow gap to scrape the interproximal surfaces.

The toothbrush of the invention can provide improved cleaning of interproximal surfaces of adjacent teeth by scraping these surfaces with the exposed edges of the blade-like fins, without causing unacceptable discomfort. Under typical conditions, the fins can penetrate interproximal areas between very closely spaced teeth to scrape the opposing surfaces of the adjacent teeth at their nearest point, even to the point of separating lightly contacting teeth to expose the normally contacting surfaces of the teeth for cleaning.

DESCRIPTION OF PREFERRED EMBODIMENTS

Figure 1:
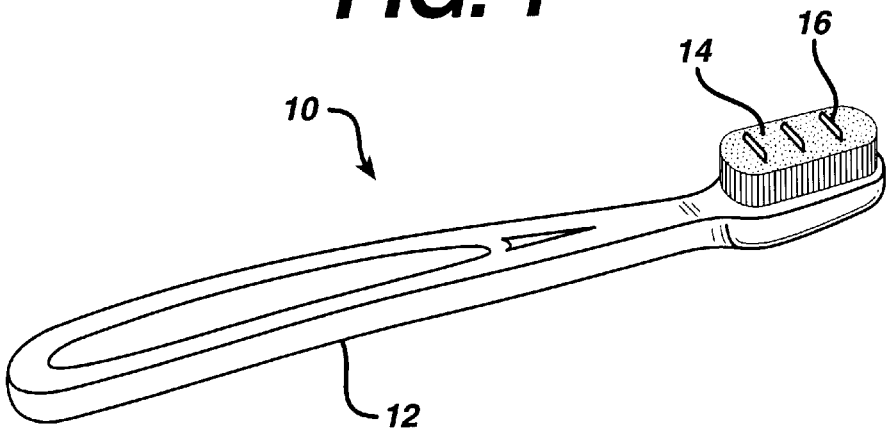
FIG. 1 is a perspective view of a toothbrush according to the invention.
Figure 1A:
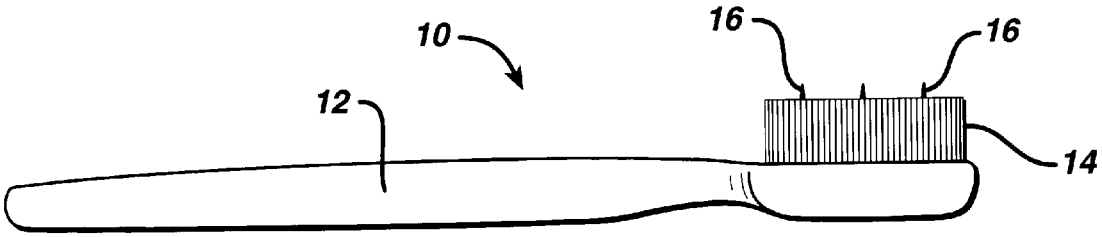
FIG. 1A is a side view of the toothbrush of FIG. 1.

Referring first to FIG. 1, a toothbrush 10 has an elongated plastic handle 12 and a brush 14 made up of a multiplicity of individual bristles attached to and extending from handle 12. Fins 16, attached at their bases to the handle, extend through the brush and project about 0.4 to 0.6 inch beyond the bristles.

Figure 2:
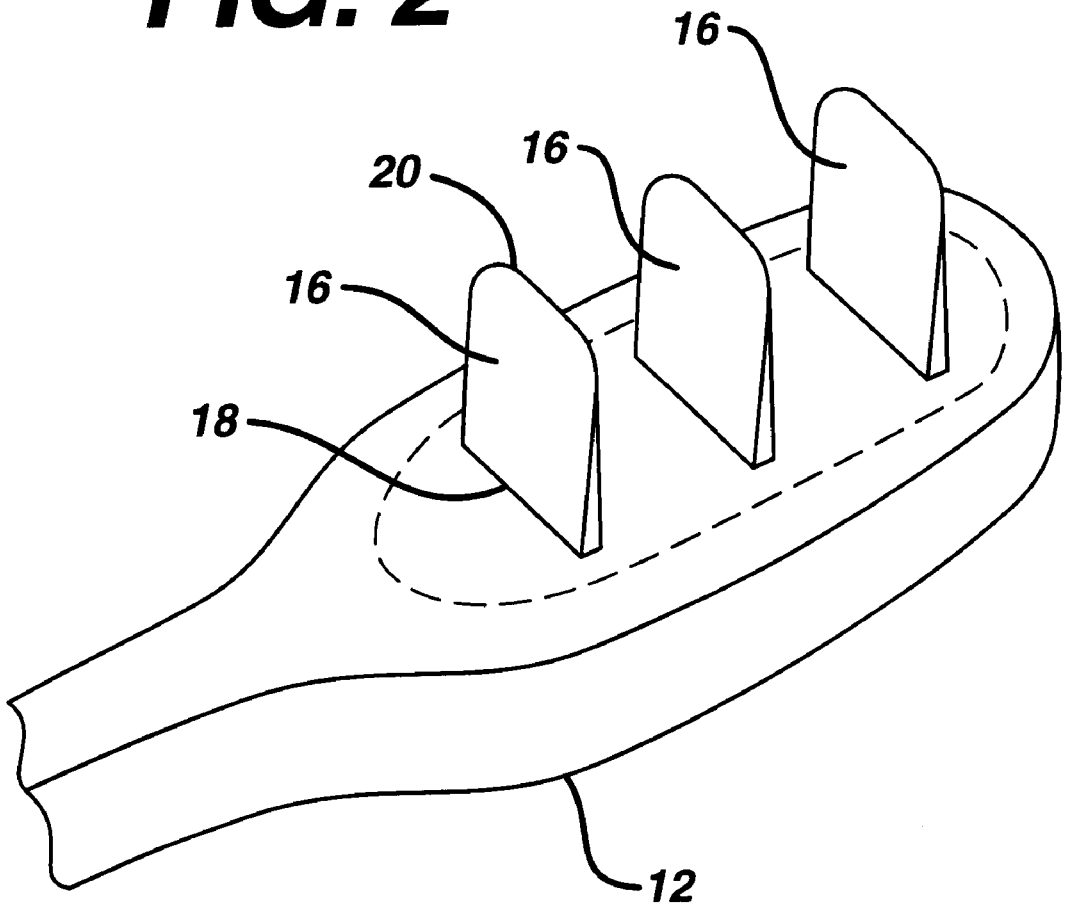
FIG. 2 is an enlarged view of the head of the toothbrush, with the bristles removed to show the fins.

FIG. 2 shows the head of toothbrush 10 with the bristles removed to show fins 16. Each injection-molded fin 16 is blade-like, with a thickness that tapers from a maximum at the base 18 of the fin to a sharp edge 20. The fins are preferably insert-molded into handle 12, and are arranged to lie in planes which are generally perpendicular to the length of the handle. The construction of the fins is such that they are flexible to bend about their firmly attached bases 18 and, to a limited degree, twist out of their planes to allow their distal edges 20 to conform to tooth surfaces.

A primary function of fins 16 is to clean the interproximal surfaces between teeth by scraping motion at edges 20, for example as illustrated in FIGS. 3 and 3A, 4 and 4A, and 5. In these figures the bristles of the toothbrush are not shown, and only one fin is shown, for purpose of illustration.

Figure 3:
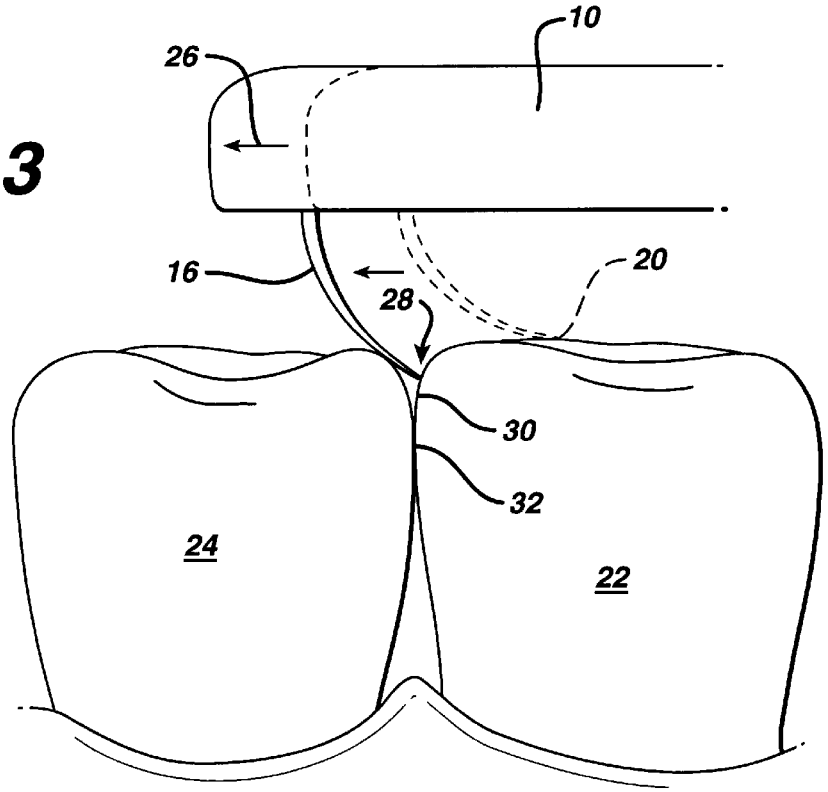
FIGS. 3 and 3A sequentially illustrate the fin of the toothbrush engaging an interproximal area from the top of adjacent teeth.

Referring to FIG. 3, as toothbrush 10 is moved along the upper surfaces of adjacent teeth 22 and 24 in the direction indicated by arrow 26 from a first position (indicated by dashed lines) to a second position (indicated by solid lines), distal edge 20 slides along the upper surface of tooth 22, with cantilevered fin 16 deflected by pressure between the toothbrush and the teeth. Although not shown, it should be understood that the bristles of the toothbrush are also deflected by this normal pressure. When the fin reaches its second position at gap 28 between the teeth, the distal edge 20 of the fin is directed toward the interproximal surface 30 of tooth 22. Teeth 22 and 24 are shown as normally contacting teeth, with their interproximal surfaces in contact at point 32.

Figure 3A:
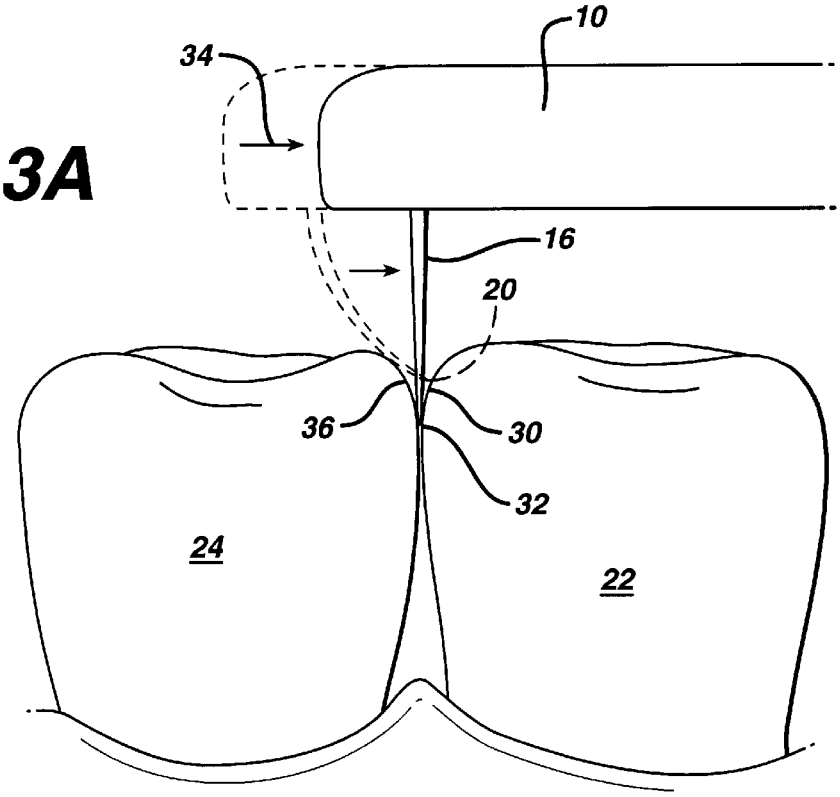

Referring now to FIG. 3A, if the direction of brushing is then reversed from that of FIG. 3, as indicated by arrow 34, with toothbrush 10 moving from its second position (indicated by dashed lines) to a third position (indicated by solid lines), edge 20 scrapes along surface 30 of tooth 22 to help remove any debris on surface 30. At its point of maximum penetration into gap 28, edge 20 of fin 16 preferably reaches contact point 32, temporarily separating teeth 22 and 24 a very slight amount (for instance, a few thousandths of an inch or so) to permit fin 16 to clean surface 30 down to point 32. Although not illustrated, it should be understood how a similar sequence of motions can be applied to the toothbrush to clean facing surface 36 of adjacent tooth 24.

Figure 4:
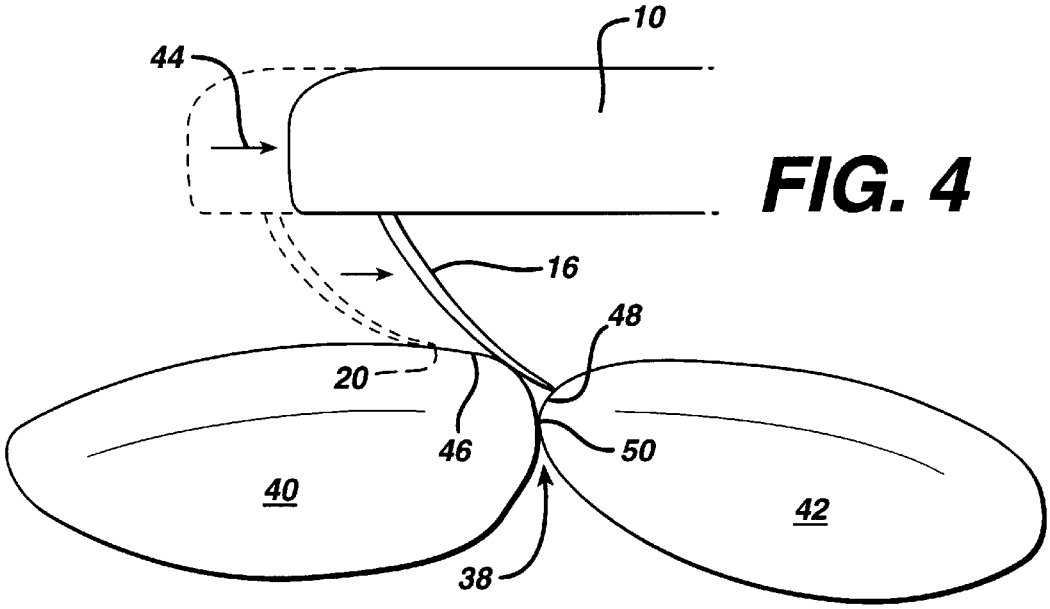
FIGS. 4 and 4A sequentially illustrate the fin of the toothbrush engaging an interproximal area from the labial side of adjacent teeth.
Figure 4A:
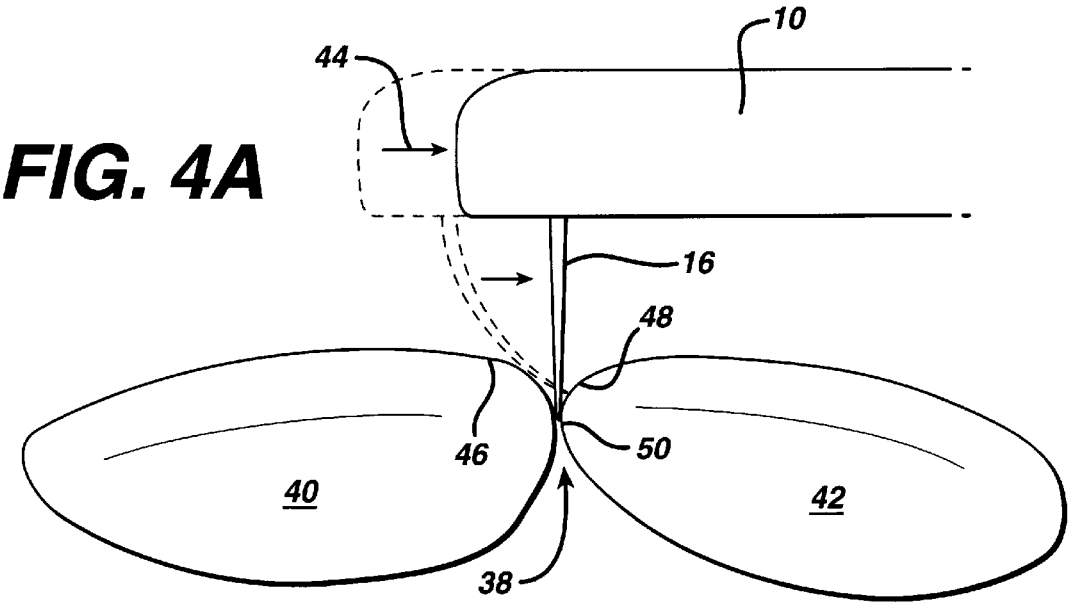

Similarly, FIGS. 4 and 4A illustrate fin 16 penetrating the interproximal gap between adjacent bicuspids 40 and 42. In this sequence, fin 16 is shown deflected to extend in the direction of motion, indicated by arrow 44. As the toothbrush is moved from a first position (indicated by dashed lines) to a second position (indicated by solid lines), edge 20 of the fin scrapes against and cleans the facial surface 46 of tooth 40. Upon reaching gap 38, edge 20 is poised to scrape against interproximal surface 48 of adjacent tooth 42. For purposes of illustration, teeth 40 and 42 are shown to be in normal contact at point 50.

Further motion of the toothbrush, illustrated by FIG. 4A, causes edge 20 to penetrate between teeth 40 and 42, temporarily separating the teeth a sufficient amount to enable the distal edge of the fin to clean between them.

Figure 5:
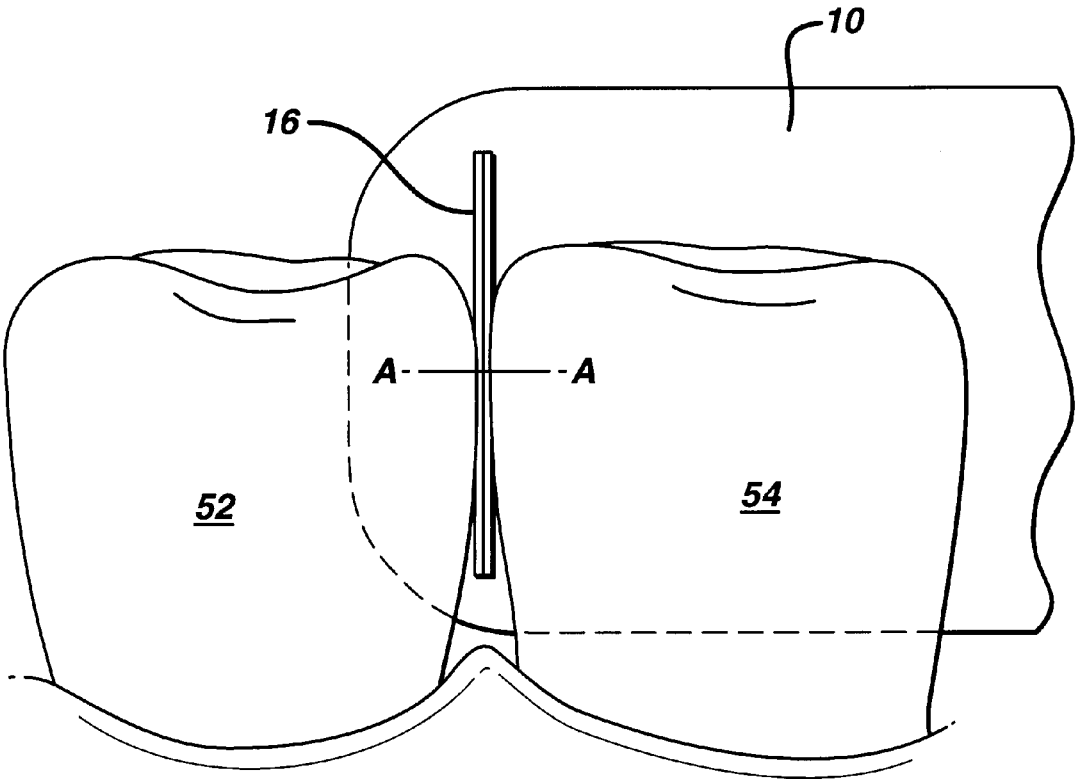
FIG. 5 is a lingual side view of a fin penetrating an interproximal area between teeth.

FIG. 5 shows fin 16 separating contact between molars 52 and 54, which normally contact at line A—A. As is illustrated in this view, the flexibility of the distal edge of the fin allows it to conform to the shape of the adjacent teeth in the vicinity of the normal contact point to more effectively scrape against a broader area of the tooth. At the same time, the fin is sufficiently stiff to resist buckling and penetrate between the teeth, unlike bristle filaments, which have a very low buckling strength by comparison and tend to be separated by the contact region between the teeth, bending away either above or below line A—A. Due in part to the blade-like construction of fin 16, there is no tendency of the fin to be deflected away from line A—A and the contact region between the teeth.

Fins 16 should, therefore, be constructed to be sufficiently stiff to resist buckling, sufficiently thin to penetrate narrow gaps between teeth, and yet not too rigid to cause discomfort. The following figures show three preferred fin embodiments.

Figure 6:
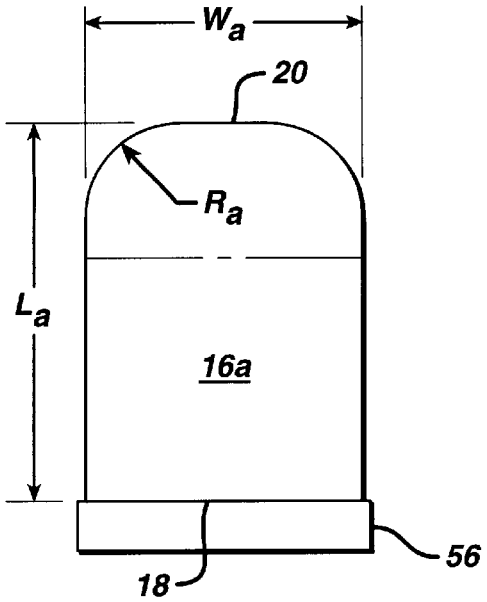
FIG. 6 is a plan view of a first embodiment of a fin.
Figure 6A:
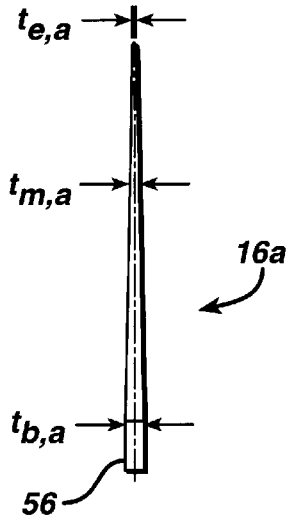
FIG. 6A is a side view of the fin of FIG. 6.

Referring to FIGS. 6 and 6A, the first fin embodiment 16*a* is a solid, tapering blade with a rectangular base 56 for insert-molding into the body of a toothbrush. From base 56, the tapering main portion of the fin extends a total length $L_a$ of 0.40 inch, and has a width $W_a$ of 0.29 inch. The blade tapers in thickness from a thickness $t_{b,a}$ at the base of 0.020 inch, to a thickness $t_{m,a}$ of 0.008 inch at a distance of 0.25 inch from the base, and to an edge thickness $t_{e,a}$ of 0.002 inch. The ends of distal edge 20 (i.e., the corners of the fin) are rounded, with a radius $R_a$ of 0.10 inch, for comfort.

Figure 7:
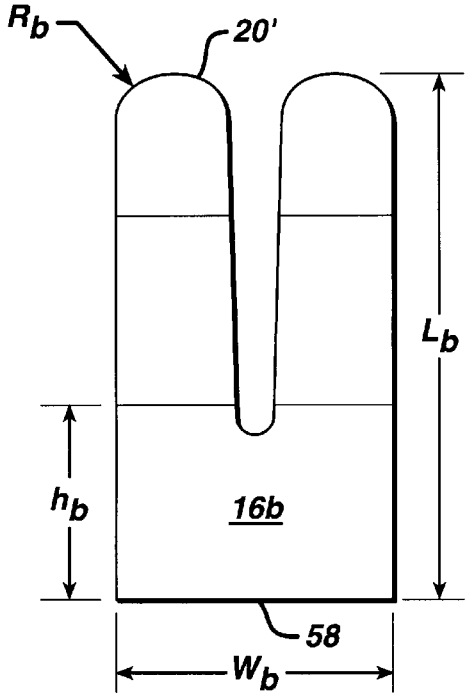
FIG. 7 is a plan view of a second embodiment of a fin.
Figure 7A:
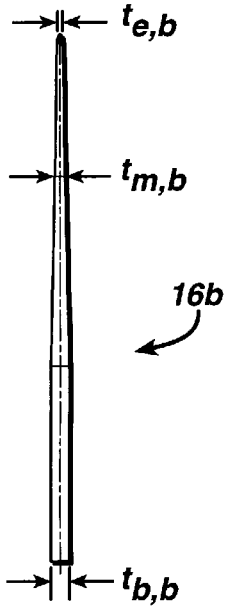
FIG. 7A is a side view of the fin of FIG. 7.

Referring to FIGS. 7 and 7A, the second fin embodiment 16*b* is a split, tapering blade with a rectangular base 58 that is only partially insert-molded into the toothbrush body. The base has an overall height $h_b$ of 0.20 inch and a width $W_b$ of 0.29 inch. The fin has an overall length $L_b$ of 0.55 inch. The blade tapers in thickness from a thickness $t_{b,b}$, at the base, of 0.020 inch, to a thickness $t_{m,b}$ of 0.008 inch at a distance of 0.20 inch from the base, to an edge thickness $t_{e,b}$ of 0.002 inch. The ends of distal edges 20' are rounded, with a radius $R_b$ of 0.05 inch, for comfort.

Figure 8:
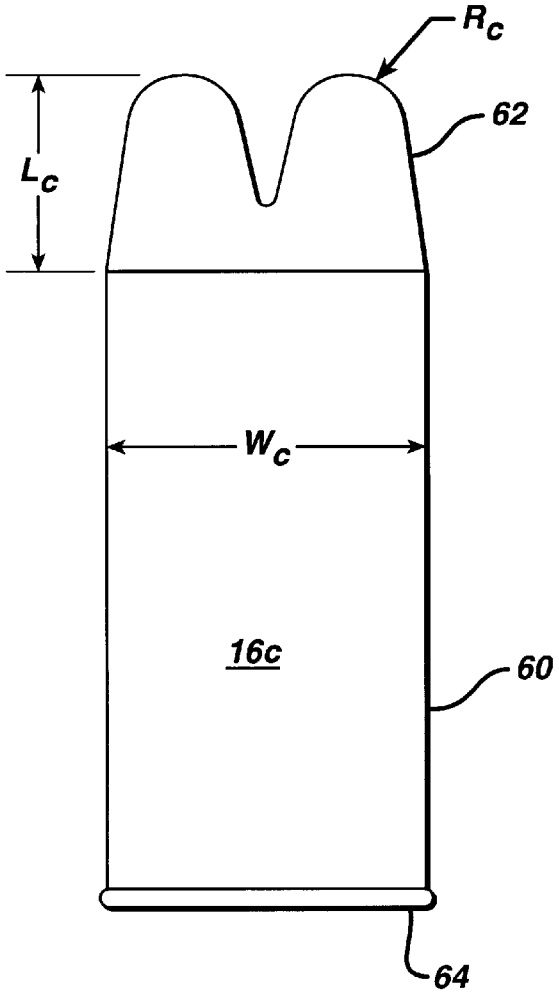
FIG. 8 is a plan view of a third embodiment of a fin.
Figure 8A:
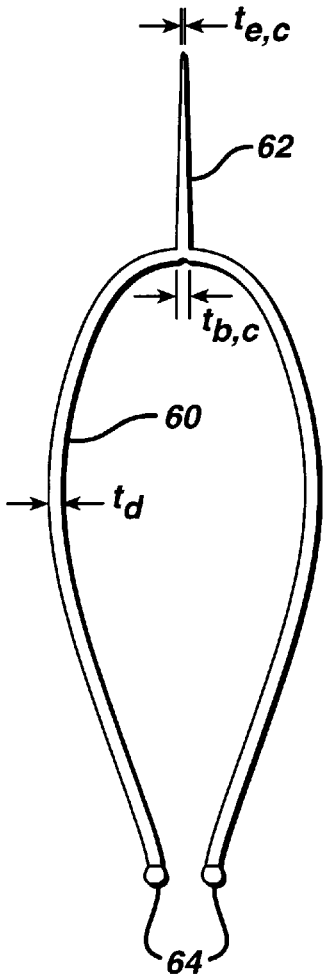
FIG. 8A is a side view of the fin of FIG. 8.

Lab tests have indicated a substantial improvement in penetration with finned toothbrushes, as compared to standard toothbrushes. The fins of FIGS. 7 and 7A were also tested in focus groups and were generally perceived to function as intended. In early clinical trials, these fins have been found to be effective for reduction of bleeding and gum inflammation, with rough prototype toothbrushes with fins performing about the same as production quality brushes without fins. (These early clinical results are encouraging, as we find that production quality brushes typically outperform prototype brushes with identical features in such studies.) Referring to FIGS. 8 and 8A, the third fin embodiment 16*c* has a thin, ribbon-like loop portion 60 and a split blade portion 62 extending from one side of the loop portion, midway between the two base ends 64. Base ends 64 are insert-molded into the body of the toothbrush in close proximity to one another, leaving the rest of loop portion 60 exposed to function as a spring to bias blade portion 62 away from the body of the toothbrush. Blade portion 62 extends only a distance $L_c$ of 0.14 inch from loop portion 60, and is designed to penetrate into the interproximal spaces between adjacent teeth due to the bias load exerted by loop portion 60 as the brush portion of the toothbrush is moved back and forth, under pressure, across adjacent teeth. The two ears of blade portion 62 have distal end radii $R_c$ of about 0.04 inch, and taper in thickness from a thickness $t_{b,c}$, at loop portion 60, of 0.015 inch, to an edge thickness $t_{e,c}$ of 0.0034 inch. Loop portion 60 has a width $W_c$ of 0.29 inch, an overall length of 1.5 inches, and a thickness $t_d$ of 0.010 inch.

Figure 9:
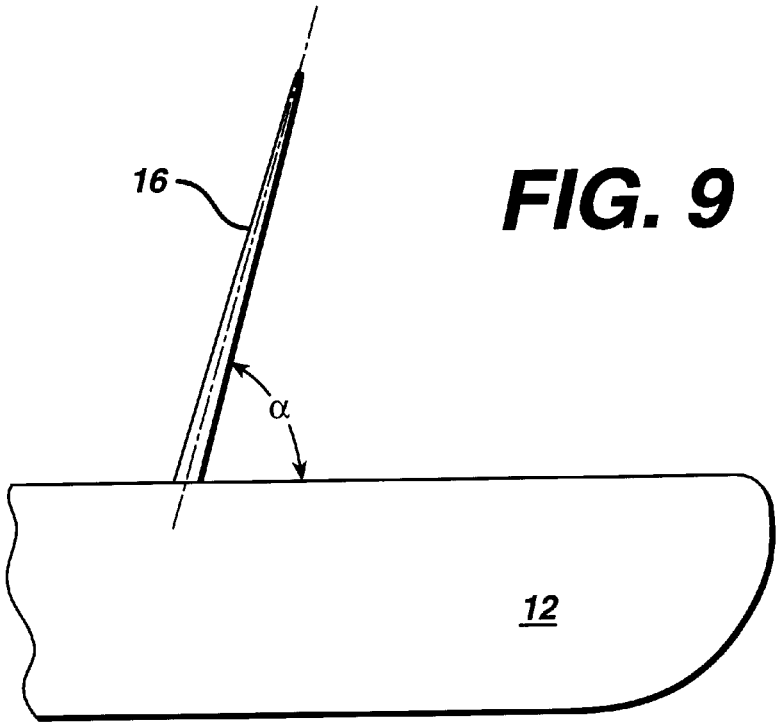
FIG. 9 shows a fin extending at an acute angle from a face of the toothbrush.

The above figures illustrate the fins as extending generally perpendicularly from a face of the body of the toothbrush. Referring to FIG. 9, we have found that another advantageous arrangement is to cant at least one of the fins to extend at an acute angle, $\alpha$, of between about 65 and 80 degrees, preferably between about 70 and 75 degrees, and most preferably about 73 degrees, from the body.

Figure 10:
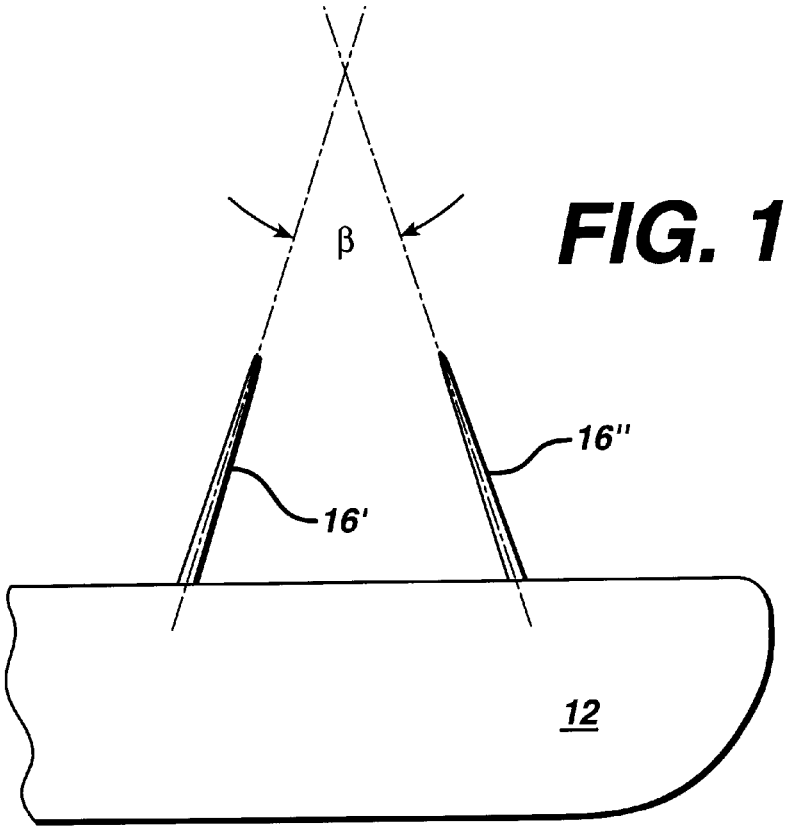
FIG. 10 shows two fins canted to extend toward each other.

Referring to FIG. 10, in another embodiment two adjacent fins 16' and 16" are canted toward each other, forming an angle, $\beta$, of between about 20 and 50 degrees, preferably between about 30 and 40 degrees, most preferably about 34 degrees, between them. Fins 16' and 16" exhibit the cleaning motion of the fin illustrated in FIG. 9 on forward and return brushing strokes, respectively.

All three of the embodiments of fins 16 illustrated in FIGS. 6, 7 and 8 can be readily molded by standard injection molding techniques from thermoplastic resins. We presently prefer to mold the fins from polyamide (e.g., GRILAMID™ ELY20NZ from EMS American Grilon, Inc. of Sumter, S.C.). Other preferred materials include polyurethane elastomers, such as PELLETHANE™ 2103 from Dow Chemical Co. in Midland, Mich., or polyester elastomers, such as HYTREL™ 7246 from DuPont Co. in Wilmington, Del. Suitable fin materials also include polyolefin plastomers and elastomers, nylons (e.g., nylon 6/12), and acetal resins.

For acceptable wear resistance in a molded fin, the injection mold cavity surfaces should be maintained at a relatively high temperature (but below melt temperature) to effectively anneal the cooling fin to reduce internal stresses caused by shear as the melt is forced along the narrow cavity. For example, acceptable nylon fin wear characteristics may be acheived by maintaining the mold at about 150 to 175 degrees Fahrenheit. Orientation of the molecular chains of the resin in the region of the tip of the fin, especially in a direction along the length of the fin, can particularly increase wear properties in use. Such orientation can be achieved in an injection molding process by stretching the tip region (in a direction along the fin length) during mold release and ejection. For instance, a molded blank comprising two opposing fins joined at their tips can be stretched upon ejection by pulling the blank at the two fin bases, stretching and thinning their tip regions while the blank is still warm. The blank can subsequently be trimmed to produce two fins with thinned, wear resistant tips. Rubber thermoset materials can be compression molded for wear resistance. Wear characteristics may also be improved with fins molded from post-curable polyurethanes (e.g., PELLETHANE™) by curing the fins after molding to increase the effective molecular weight of the polymer. Two-part urethanes can also be mixed in the mold.

Alternatively, the illustrated fins may be stamped from an extrusion having an appropriately tapered profile corresponding to the side profile of the fin. In such cases the orientation of the molecules of the extrusion may help to provide acceptable wear properties. Materials which normally have cross-molecule bonding, such as nylons, may be suitable for such production methods. The extrusion may be stretched in a cross-profile direction to provide at least a substantial amount of molecular orientation in the desired direction. Extrusions having thick edges and tapering middle sections can be transversely stretched upon leaving the extrusion die, or in a subsequent operation upon reheating, to thin and orient the tapering middle section. Such an oriented extrusion can then be run through a die-cutting nip to cut two opposing rows of fins from the extrusion, with the thicker edges of the stretched extrusion forming the bases of the fins. Methods of post-orienting extruded resins can be found in Russell, U.S. Pat. No. 4,276,255, and Paradis, U.S. Pat. No. 4,304,743, both of which are hereby incorporated by reference. Curable urethanes can be cured after extrusion to increase molecular weight for better wear properties.

The fins may also serve as wear indicators to signify when the brush should be replaced. For instance, portions of the fins may be designed to change physical appearance (e.g., color) with extended use. This effect may be achieved, for instance, by co-extruding a wear-indicating, colored material with the fin extrusion, or by coating or dyeing the fins with a wear indicator. The fin resin itself may also be formulated to change color with use, in order to indicate wear.

For the illustrated geometries (which have long, narrowly tapering cross sections for penetrating narrow gaps, having a base thickness of between about 3 percent and 7 percent of the length of the fin) to be constructed stiff enough to sufficiently resist buckling to penetration between teeth, the bending modulus of the fin material should be between about 2,000 and 500,000 pounds per square inch, preferably between about 2,000 and 200,000 pounds per square inch, and most preferably between about 10,000 and 100,000 pounds per square inch. Bending modulus, as used herein, should be understood to be the material's resistance to bending, as defined by ASTM Method D790, available from the American Society of Testing of Materials in West Conshohocken, Pa. and which is incorporated herein by reference.

The above fin constructions were all produced from GRILAMID™ (see above), mounted in bristled toothbrushes and lab tested on a cleaning effectiveness/plaque removal model. The tests were designed to assess the cleaning area and interproximal penetration under a predetermined set of conditions, controlling the amount of brushing force, the brushing pattern and the duration of brushing. All three fin constructions exhibited superior penetration when compared to examples of current toothbrushes.

Other features and embodiments will be found to fall within the scope of the following claims.

What is claimed is:

1. A toothbrush for cleaning the interproximal region between adjacent, normally contacting teeth, comprising a body, bristles attached to and extending from said body to form a brush for cleaning the teeth, and a contact-breaking fin extending from a locally flat surface of said body, the extension of the fin from the body defining an extension angle with said surface of between about 65 and 80 degrees, the fin having a distal end that is sufficiently thin so that said fin is capable of temporarily separating said teeth to penetrate and clean said interproximal region during toothbrushing.

2. The toothbrush of claim 1 wherein the fin is disposed among the bristles.

3. The toothbrush of claim 1 wherein the fin has a thickness which tapers away from the body toward the distal end of the fin.

4. The toothbrush of claim 3 wherein the thickness of the distal end of the fin is less than about 0.005 inch.

5. The toothbrush of claim 4 wherein the thickness of the distal end of the fin is less than about 0.002 inch.

6. The toothbrush of claim 3 wherein the thickness of the fin defines an included taper angle, between two opposite sides of the fin, of between about 0.2 and 12 degrees.

7. The toothbrush of claim 6 wherein the included taper angle is between about 0.4 and 2.6 degrees.

8. The toothbrush of claim 6 wherein the included taper angle is about 2.0 degrees.

9. The toothbrush of claim 1 wherein the fin comprises a plastic resin with a bending modulus of between about 2,000 and 500,000 pounds per square inch.

10. The toothbrush of claim 9 wherein the fin comprises a plastic resin with a bending modulus of between about 2,000 and 200,000 pounds per square inch.

11. The toothbrush of claim 10 wherein the fin comprises a plastic resin with a bending modulus of between about 10,000 and 100,000 pounds per square inch.

12. The toothbrush of claim 1 wherein the fin comprises a plastic resin selected from the group of elastomeric materials consisting of polyamide, polyurethane and polyester.

13. The toothbrush of claim 1 wherein the fin comprises elastomeric polyamide.

14. The toothbrush of claim 1 wherein the extension angle is between about 70 and 75 degrees.

15. The toothbrush of claim 14 wherein the extension angle is about 73 degrees.

16. The toothbrush of claim 1 having two said fins arranged to extend from the body toward one another.

17. The toothbrush of claim 16 wherein the extended fins are spaced apart from one another at the body and define therebetween an included angle of between about 20 and 50 degrees.

18. The toothbrush of claim 17 wherein the included angle between the fins is between about 30 and 40 degrees.

19. The toothbrush of claim 18 wherein the included angle between the fins is about 34 degrees.

20. The toothbrush of claim 1 wherein the fin comprises two normally co-planar extensions having separate distal ends and joined together at a base region, such that the distal ends of the extensions are independently deflectable.

21. The toothbrush of claim 1 wherein the fin comprises a ribbon-form loop portion extending from the body, the loop portion having two ends attached to the body such that the loop portion is bowed away from the body, and a contact-breaking portion extending from the loop portion from a point about midway between the two ends of the loop portion in a direction away from the body of the toothbrush, the loop portion being constructed to bias the contact-breaking portion away from the body.

22. The toothbrush of claim 21 wherein the contact-breaking portion has two normally co-planar extensions having separate distal ends and joined together at a base region, such that the distal ends of the extensions are independently deflectable.

23. The toothbrush of claim 1 wherein the fin has a distal edge and a side edge, the distal edge defining a corner radius with the side edge.

24. The toothbrush of claim 23 wherein the corner radius is between about 0.05 and 0.1 inch.

25. The toothbrush of claim 1 wherein the fin is constructed to change appearance with extended use.

26. A toothbrush for cleaning the interproximal region between adjacent teeth, comprising a body, multiple tooth-cleaning elements attached to and extending from said body, and a fin having two broad, opposite sides and attached to said body at a base and extending among said tooth-cleaning elements to a distal end of the fin, the fin extending from a locally flat surface of said body, the extension of the fin from the body defining an extension angle with said surface of between about 65 and 80 degrees;

the fin having a thickness which tapers away from the body toward the distal end, the thickness of the distal end of the fin being less than about 0.005 inch; and the fin comprising a plastic resin with a bending modulus of between about 10,000 and about 100,000 pounds per square inch.

27. The toothbrush of claim 26 wherein the fin thickness defines an included taper angle, between the two broad, opposite sides of the fin, of between about 0.4 and 2.6 degrees.

28. The toothbrush of claim 26 wherein the fin is constructed to temporarily separate normally contacting teeth to penetrate and clean the interproximal region between the teeth by scraping motion.

29. The toothbrush of claim 26 wherein the tooth-cleaning elements comprise bristles.

30. A toothbrush for cleaning the interproximal region between adjacent teeth, comprising a body, bristles attached to and extending from said body to form a brush for cleaning the teeth, and a fin having two broad, opposite sides and attached to said body at a base and extending through the brush to a distal end, the fin extending from a locally flat surface of said body, the extension of the fin from the body defining an extension angle with said surface of between about 65 and 80 degrees;

the fin having a thickness which defines an included taper angle, between the two broad, opposite sides of the fin, of between about 0.4 and 2.6 degrees; and the fin comprising a plastic resin with a bending modulus of between about 10,000 and about 100,000 pounds per square inch.

31. A toothbrush for cleaning the interproximal region between adjacent, normally contacting teeth, comprising a body, bristles attached to and extending from said body to form a brush for cleaning the teeth, and contact-breaking means extending from a locally flat surface of said body, the contact-breaking means being constructed to temporarily separate said teeth to penetrate and clean said interproximal region by a scraping motion, and the extension of the contact-breaking means from the body defining an extension angle with said surface of between about 65 and 80 degrees.

32. A toothbrush for cleaning the interproximal region between adjacent, normally contacting teeth, comprising a body, bristles attached to and extending from said body to form a brush for cleaning the teeth, and a contact-breaking fin extending from a locally flat surface of said body, the fin having a distal end having a thickness of less than 0.005 inch, allowing the distal end to penetrate said interproximal region during toothbrushing, and the extension of the fin from the body defining an extension angle with said surface of between about 65 and 80 degrees.

33. A toothbrush for cleaning the interproximal region between adjacent, normally contacting teeth, comprising a body, bristles attached to and extending from said body to form a brush for cleaning the teeth, and a contact-breaking fin extending from a locally flat surface of said body, the extension of the fin from the body defining an extension angle with said surface of between about 65 and 80 degrees, and the fin being constructed to temporarily separate said teeth to penetrate and clean said interproximal region by scraping motion.

34. A toothbrush for cleaning the interproximal region between adjacent, normally contacting teeth, comprising a body, bristles attached to and extending from said body to form a brush for cleaning the teeth, and a pair of contact-breaking fins extending from said body toward each other, each fin being constructed to temporarily separate said teeth to penetrate and clean said interproximal region by scraping motion.

35. The toothbrush of claim 34 wherein the extended fins are spaced apart from one another at the body and define therebetween an included angle of between about 20 and 50 degrees.

36. A toothbrush for cleaning the interproximal region between adjacent, normally contacting teeth, comprising a body, bristles attached to and extending from said body to form a brush for cleaning the teeth, and a contact-breaking fin extending from said body, the fin constructed to temporarily separate said teeth to penetrate and clean said interproximal region by scraping motion, the fin comprising a ribbon-form loop portion extending from the body, the loop portion having two ends attached to the body such that the loop portion is bowed away from the body, and a contact-breaking portion extending from the loop portion from a point about midway between the two ends of the loop portion in a direction away from the body of the toothbrush, the loop portion being constructed to bias the contact-breaking portion away from the body.

37. A toothbrush for cleaning the interproximal region between adjacent, normally contacting teeth, comprising a body, bristles attached to and extending from said body to form a brush for cleaning the teeth, and a contact-breaking fin extending from a locally flat surface of said body, the extension of the fin from the body defining an extension angle with said surface of between about 65 and 80 degrees the fin having a distal end that is sufficiently thin so that said fin is capable of penetrating said interproximal region during toothbrushing, said fin comprising a plastic resin with a bending modulus of between about 10,000 and about 100,000 pounds per square inch.

38. A toothbrush for cleaning the interproximal region between adjacent, normally contacting teeth, comprising a body, bristles attached to and extending from said body to form a brush for cleaning the teeth, and a pair of contact-breaking fins arranged to extend from said body towards each other, each fin having a distal end that is sufficiently thin so that said fin is capable of temporarily separating said teeth to penetrate and clean said interproximal region during toothbrushing.

39. The toothbrush of claim 38 wherein the extended fins are spaced apart from one another at the body and define therebetween an included angle of between about 20 and 50 degrees.

40. The toothbrush of claim 39 wherein the included angle between the fins is between about 30 and 40 degrees.

41. A toothbrush for cleaning the interproximal region between adjacent, normally contacting teeth, comprising a body, bristles attached to and extending from said body to form a brush for cleaning the teeth, and a contact-breaking fin extending from said body, said fin having a distal end that is sufficiently thin so that said fin is capable of temporarily separating said teeth to penetrate and clean said interproximal region during toothbrushing;

wherein the fin comprises a ribbon-form loop portion extending from the body, the loop portion having two ends attached to the body such that the loop portion is bowed away from the body, and a contact-breaking portion extending from the loop portion from a point about midway between the two ends of the loop portion in a direction away from the body of the toothbrush, the loop portion being constructed to bias the contact-breaking portion away from the body.

42. The toothbrush of claim 41 wherein the contact-breaking portion has two normally co-planar extensions having separate distal ends and joined together at a base region, such that the distal ends of the extensions are independently deflectable.

* * * * *